US006116967A

United States Patent [19]

Yeah

[11] Patent Number: 6,116,967

[45] Date of Patent: Sep. 12, 2000

[54] RECEPTACLE ASSEMBLY FOR A POWER SUPPLY

[76] Inventor: Solomon Yeah, 20th Fl., No. 105, Sec. 2, Tunhua S. Rd., Taipei, Taiwan

[21] Appl. No.: 09/235,352

[22] Filed: Jan. 21, 1999

[51] Int. Cl.[7] ..... H01R 13/432

[52] U.S. Cl. ..... 439/748

[58] Field of Search ..... 439/746, 747, 439/748, 749, 751, 733.1, 650

[56] References Cited

U.S. PATENT DOCUMENTS 4,660,915 4/1987 Mantlik ..... 439/747

*Primary Examiner*—Paula Bradley
*Assistant Examiner*—Briggitte R. Hammond
*Attorney, Agent, or Firm*—Thomas, Kayden, Horstemeyer & Risley LLP

[57] ABSTRACT

A receptacle assembly includes a casing having a closed side and an open side, at least one receptacle hole module defined in the casing, and containing a plurality of insertion holes defined in the closed side of the casing, a plurality of extension columns each extending from the closed side of the casing, and each containing a receiving channel therein aligning with one of the corresponding insertion holes, each of the extension columns including a positioning block formed in the wall of the receiving channel, and a plurality of conductive terminals each received in the receiving channel of one of the corresponding extension columns and each abutting the positioning block such that each of the conductive terminals is fixed in the receiving channel by the positioning block.

7 Claims, 3 Drawing Sheets

RECEPTACLE ASSEMBLY FOR A POWER SUPPLY

CROSS-REFERENCES TO RELATED APPLICATIONS

Not Applicable.

BACKGROUND OF THE INVENTION

1. Field of the Invention

The present invention relates to a receptacle assembly for a power supply.

2. Description of the Related Art

A conventional receptacle assembly for a power supply in accordance with the prior art shown in FIGS. 4 and 5 comprises a casing (40) having a closed side and an open side, a plurality of receptacle hole modules (42) each defined in the casing (40) and each containing a plurality of, insertion holes (420) defined in the closed side of the casing (40), a plurality of lugs (44) extending from the closed side of the casing (40) and each containing a receiving space (440) therein aligning with one of the corresponding insertion holes (420), and a plurality of conductive terminals (52) each received in the receiving space (440) of one of the corresponding lugs (44). Each of the conductive terminals (52) is attached to an elongated terminal plate (50).

In assembly, each of the conductive terminals (52) is initially inserted into the receiving space (440) of the respective lug (44) to align with the respective insertion hole (420). The terminal plate (50) is then connected to a power supply (not shown), and a cover (not shown) is then attached to the open side of the casing (40), thereby accomplishing the assembly of the receptacle assembly. A plug (not shown) including a plurality of blades (not shown) can then be inserted into the casing (40) of the receptacle assembly through the insertion holes (420), with each of the blades being respectively received in the respective conductive terminal (52) such that the electric current from the power supply can be supplied from the receptacle assembly into the plug by means of the electric connection between the blades and the conductive terminals (52) so to be used by an electric appliance (not shown).

However, there is no fastening device provided to retain each of the conductive terminals (52) in the receiving space (440) such that the conductive terminals (52) are easily detached from the receiving space (440) of the lugs (44) during the assembly or transportation process, thereby causing inconvenience to a user. The present invention has arisen to mitigate and/or obviate the disadvantage of the conventional receptacle assembly.

BRIEF SUMMARY OF THE INVENTION

In accordance with one aspect of the present invention, there is provided a receptacle assembly comprising: a casing having a closed side and an open side; at least one receptacle hole module defined in the casing, and containing a plurality of insertion holes defined in the closed side of the casing; a plurality of extension columns each extending from the closed side of the casing, and each containing a receiving channel therein aligning with one of the corresponding insertion holes, each of the extension columns including a positioning block formed in the wall of the receiving channel; and a plurality of conductive terminals each received in the receiving channel of one of the corresponding extension columns and each abutting the positioning block such that each of the conductive terminals is fixed in the receiving channel by the positioning block.

Each of the conductive terminals includes two parallel flexible conductive strips received in the receiving channel each having a first end portion and a second end portion, the second end portion abutting the positioning block. Each of the two conductive strips of each of the conductive terminals has its first end portion extending outward relative to each other in an inclined manner to abut the wall of the receiving channel, and has its second end portion extending toward each other in an inclined manner to abut the positioning block.

The positioning block of each of the extension columns has a triangular cross-section, and is tapered toward the open side of the casing.

The receptacle assembly further comprises an elongated terminal plate, wherein each of the conductive terminals is attached to the terminal plate.

Further benefits and advantages of the present invention will become apparent after a careful reading of the detailed description with appropriate reference to the accompanying drawings.

DETAILED DESCRIPTION OF THE INVENTION

Figure 1:
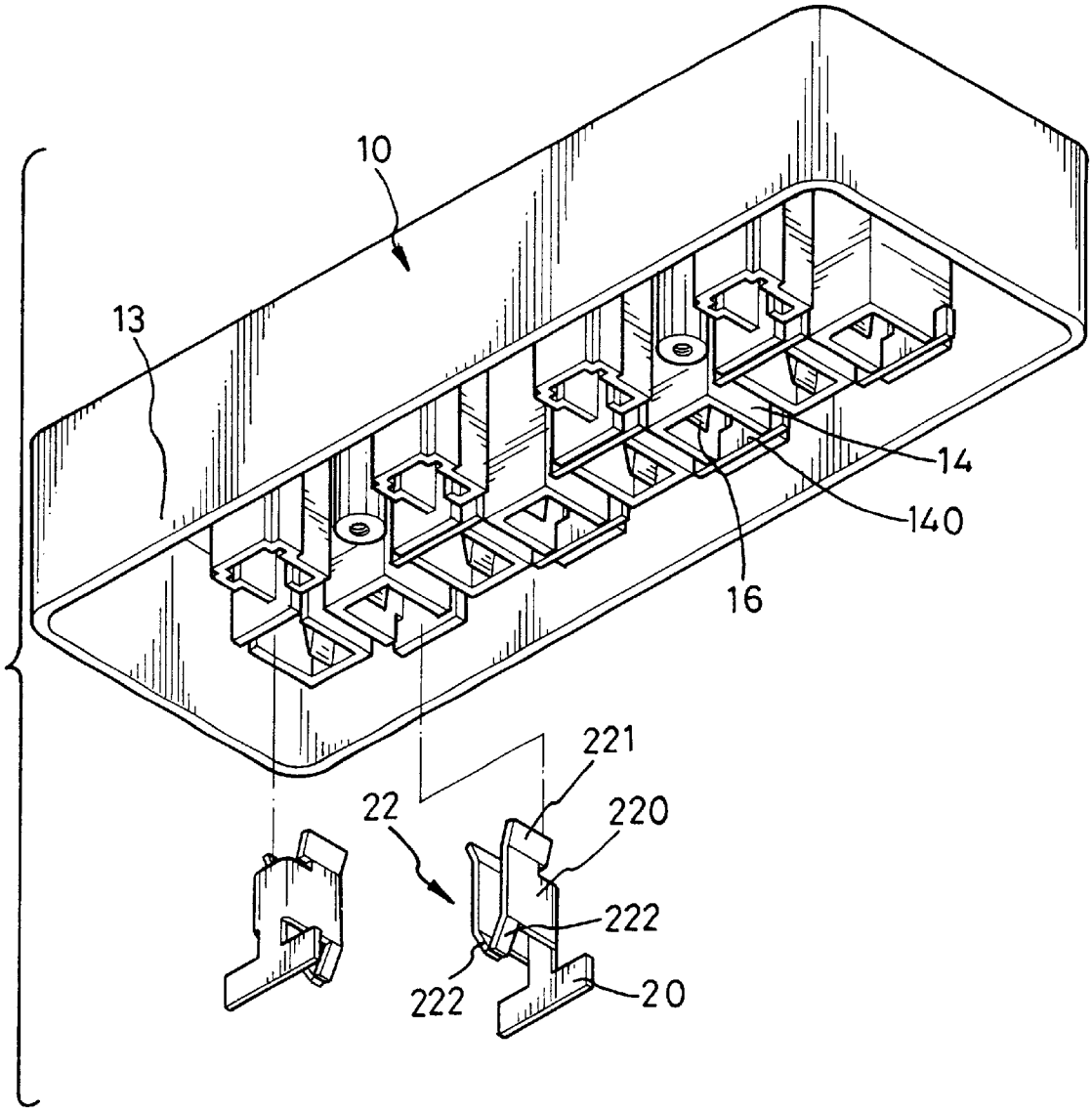
FIG. 1 is an exploded perspective view of a receptacle assembly for a power supply in accordance with the present invention.
Figure 2:
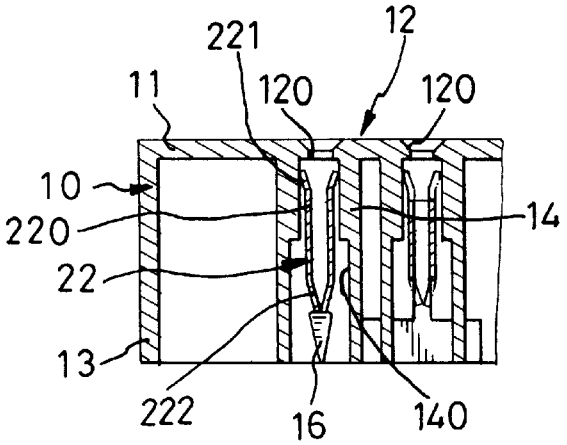
FIG. 2 is a front plan partially cut-away cross-sectional assembly view of the receptacle assembly as shown in FIG. 1.

Referring now to FIGS. 1 and 2, a receptacle assembly for a power supply in accordance with the present invention comprises a casing (10) having a closed side (11) and an open side (13), a plurality of receptacle hole modules (12) each defined in the casing (10), and each containing a plurality of, preferably three, insertion holes (120) defined in the closed side (11) of the casing (10), a plurality of extension columns (14) each extending from the closed side (11) of the casing (10), and each containing a receiving channel (140) therein aligning with one of the corresponding insertion holes (120), each of the extension columns (14) including a positioning block (16) formed in the wall of the receiving channel (140), and a plurality of conductive terminals (22) each received in the receiving channel (140) of one of the corresponding extension columns (14) and each abutting the positioning block (16) such that each of the conductive terminals (22) is fixed in the receiving channel (140) by the positioning block (16). Each of the conductive terminals (22) is attached to a terminal plate (20).

Each of the plurality of conductive terminals (22) includes two parallel flexible conductive strips (220) received in the receiving channel (140) each having a first end portion (221) extending outward relative to each other in an inclined manner to abut the wall of the receiving channel (140), and a second end portion (222) extending toward each other in an inclined manner so as to abut the positioning block (16).

The positioning block (16) of each of the extension columns (14) has a triangular cross-section, and is tapered toward the open side (13) of the casing (10).

In assembly, each of the conductive terminals (22) is initially inserted into the receiving channel (140) of the respective extension column (14) while the positioning block (16) is inserted between the two juxtaposed conductive strips (220) from the first end portion (221) thereof. When each of the conductive terminals (22) is further moved in the receiving channel (140), the second end portion (222) of each of the two conductive strips (220) is pressed outward by the positioning block (16).

The second end portion (222) of each of the two conductive strips (220) is then returned to its original position due to the flexibility of the conductive strip (220) when the positioning block (16) passes through the second end portion (222) such that each of the two conductive terminals (220) is secured in the receiving channel (140) by means of the positioning block (16) abutting the second end portion (222) of each of the two conductive strips (220) as shown in FIG. 2, thereby securing each of the conductive terminals (22) in the respective extension column (14) of the casing (10) by means of the positioning block (16).

Each of the terminal plates (20) is then connected to a power supply (not shown), and a cover (not shown) is then attached to the open side (13) of the casing (10), thereby accomplishing the assembly of the receptacle assembly. A plug (not shown) including a plurality of blades (not shown) can be inserted into the casing (10) of the receptacle assembly from the insertion holes (120), with each of the blades being respectively received between the two conductive strips (220) of the respective conductive terminal (22) such that the electric current from the power supply is supplied from the receptacle assembly into the plug by means of the electric connection between the blades and the conductive terminals (22) so to be used by an electric appliance (not shown).

In such a manner, each of the conductive terminals (22) is stably secured in the receiving channel (140) of the respective extension column (14) by means of the positioning block (16), without the possibility of detaching from the casing (10) during the assembly or transportation process. In addition, each of the conductive terminals (22) is inserted into the receiving channel (140) by guidance of the positioning block (16), thereby facilitating the assembly of the receptacle assembly.

Figure 3:
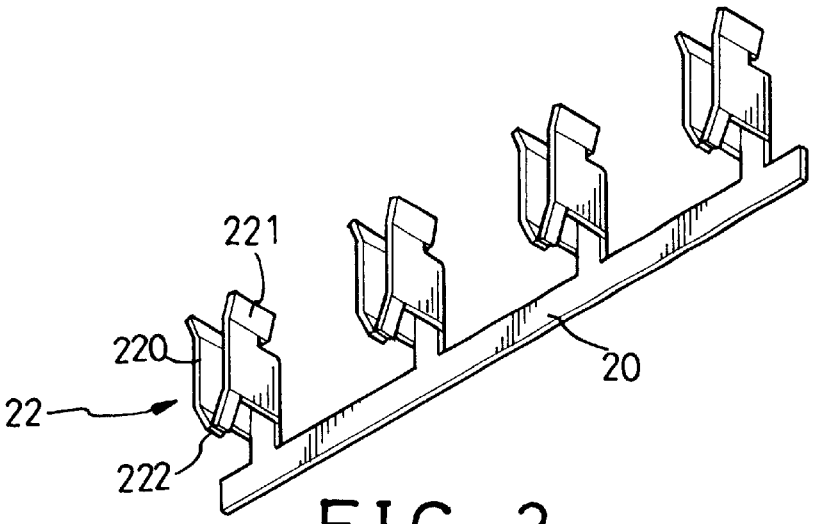
FIG. 3 is a perspective view showing a plurality of conductive terminals integrally formed with an elongated terminal plate of the receptacle assembly in accordance with another embodiment of the present invention.
Figure 5:
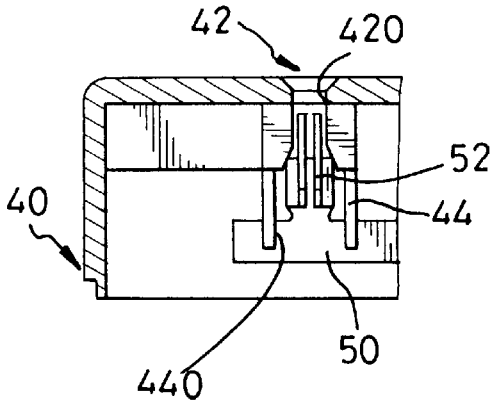
FIG. 5 PRIOR ART
FIG. 5 is a front plan partially cut-away cross-sectional assembly view of the conventional receptacle assembly as shown in FIG. 4.
Figure 4:
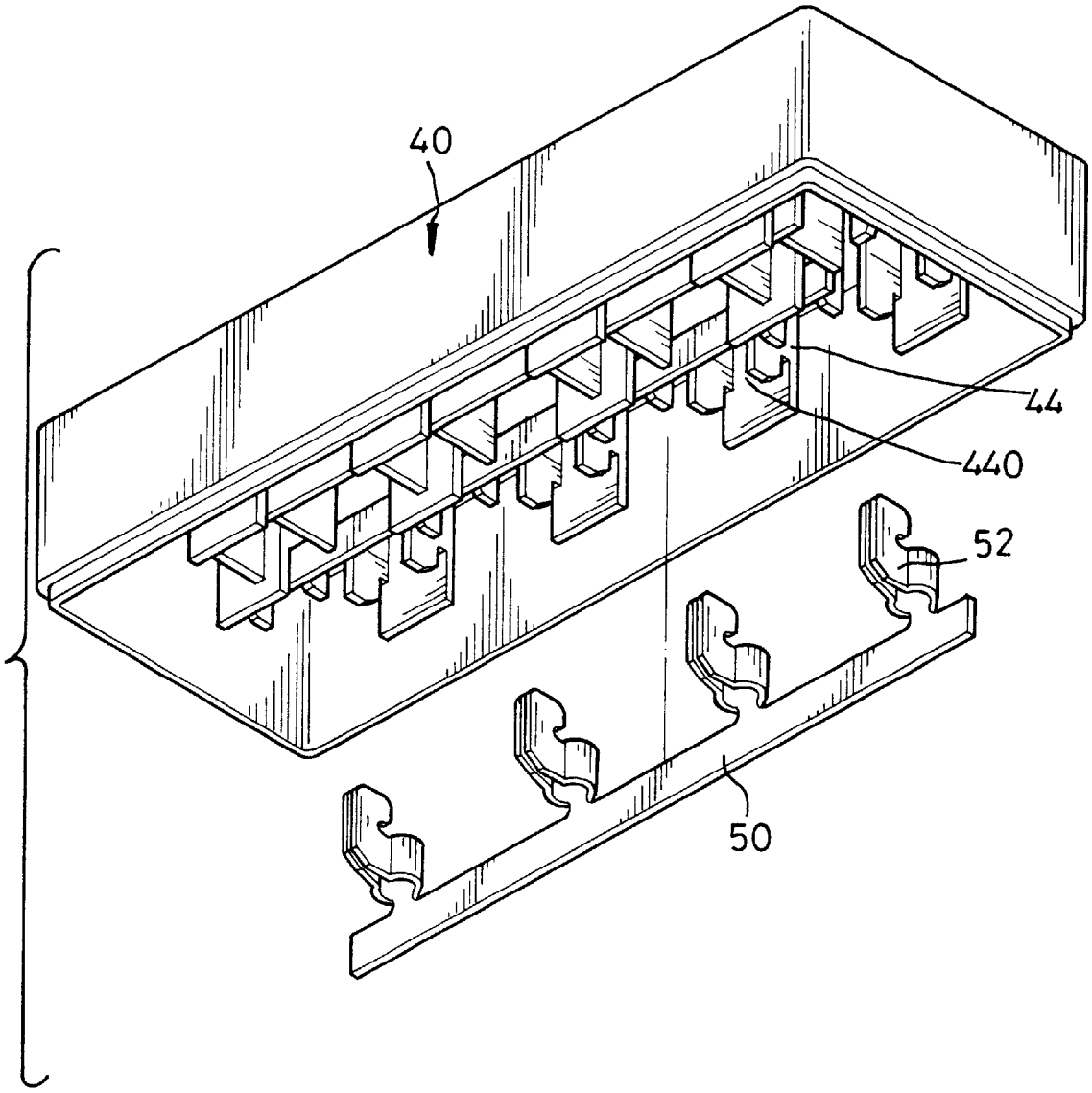
FIG. 4 PRIOR ART
FIG. 4 is an exploded perspective view of a conventional receptacle assembly for a power supply in accordance with the prior art.

Referring now to FIG. 3, in accordance with another embodiment of the present invention, all of the conductive terminals (22) are attached to or integrally formed with an elongated terminal plate (20).

It should be clear to those skilled in the art that further embodiments may be made without departing from the scope and spirit of the present invention.

What is claimed is:

1. A receptacle assembly comprising:

a casing (10) having a closed side (11) and an open side (13);

at least one receptacle hole module (12) defined in said casing (10), and containing a plurality of insertion holes (120), each of said extension columns (14) including a positioning block (16) formed in a wall of said receiving channel (140); and a plurality of conductive terminals (22) each received in said receiving channel (140) of one of said corresponding extension columns (14) and each abutting said positioning block (16) such that each of said conductive terminals (22) is fixed in said receiving channel (140) by said positioning block (16);

wherein each of said conductive terminals (22) includes two parallel conductive strips (220) received in said receiving channel (140) each having a first end portion (221) and a second end portion (222), said second end portion (222) abutting said positioning block (16); and each of said two conductive strips (220) of each of said conductive terminals (22) having its first end portion (221) extending outward relative to each other in an inclined manner to abut the wall of said receiving channel (140).

2. The receptacle assembly in accordance with claim 1, wherein each of said two conductive strips (220) of each of said conductive terminals (22) has its second end portion (222) extending toward each other in an inclined manner to abut said positioning block (16).

3. The receptacle assembly in accordance with claim 1, wherein each of said two conductive strips (220) of each of said conductive terminals (22) is flexible.

4. The receptacle assembly in accordance with claim 1, further comprising an elongated terminal plate (20), wherein each of said conductive terminals (22) is attached to said terminal plate (20).

5. The receptacle assembly in accordance with claim 1, further comprising an elongated terminal plate (20), wherein each of said conductive terminals (22) is integrally formed with said terminal plate (20).

6. The receptacle assembly in accordance with claim 1, wherein said positioning block (16) of each of said extension columns (14) has a triangular cross-section.

7. The receptacle assembly in accordance with claim 6, wherein said positioning block (16) of each of said extension columns (14) is tapered toward said open side (13) of said casing (10).

* * * * *